US009894999B2

(12) United States Patent
Bock

(10) Patent No.: US 9,894,999 B2
(45) Date of Patent: Feb. 20, 2018

(54) MECHANISM FOR AN OFFICE CHAIR

(71) Applicant: BOCK 1 GMBH & CO.KG, Postbauer-Heng (DE)

(72) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 14/766,498

(22) PCT Filed: Feb. 7, 2014

(86) PCT No.: PCT/EP2014/000336
§ 371 (c)(1),
(2) Date: Aug. 7, 2015

(87) PCT Pub. No.: WO2014/121941
PCT Pub. Date: Aug. 14, 2014

(65) Prior Publication Data

US 2015/0374132 A1 Dec. 31, 2015

(30) Foreign Application Priority Data

Feb. 7, 2013 (DE) ..... 20 2013 100 574 U

(51) Int. Cl.
*A47C 7/44* (2006.01)
*A47C 1/032* (2006.01)

(52) U.S. Cl.
CPC ..... *A47C 7/441* (2013.01); *A47C 1/03255* (2013.01); *A47C 1/03266* (2013.01); *A47C 1/03272* (2013.01); *A47C 7/443* (2013.01)

(58) Field of Classification Search
CPC ..... A47C 7/443; A47C 7/441; A47C 7/44; A47C 3/026; A47C 1/026
USPC ..... 297/303.4, 300.4, 300.5, 301.1–301.7
See application file for complete search history.

(56) References Cited

U.S. PATENT DOCUMENTS 5,328,237 A 7/1994 Yamaguchi et al.
5,685,607 A * 11/1997 Hirschmann ..... A47C 1/0325 297/300.8
5,909,923 A * 6/1999 DeKraker ..... A47C 1/023 297/285
6,582,019 B2 * 6/2003 Insalaco ..... A47C 1/03255 297/300.1
7,147,285 B2 * 12/2006 Lin ..... A47C 1/026 297/300.1

(Continued)

FOREIGN PATENT DOCUMENTS

EP 1258212 A2 * 11/2002 ..... A47C 1/03255
EP 2244605 A1 11/2010

(Continued)

*Primary Examiner* — Syed A Islam
(74) *Attorney, Agent, or Firm* — Laurence A. Greenberg; Werner H. Stemer; Ralph E. Locher

(57) ABSTRACT

A mechanism for an office chair allows a pivoting resistance of a backrest support to be altered. The mechanism for the office chair, in which a small adjustment travel is sufficient in order to realize a large adjustment range of the pivoting resistance of the backrest, has an actuating element connected to the backrest support with a supporting and/or guide track for a functional element. The functional element brings about a change in the spring tension of a spring element during pivoting of the backrest support.

11 Claims, 7 Drawing Sheets

(56) References Cited

U.S. PATENT DOCUMENTS

| | | | | |
|---|---|---|---|---|
| 7,866,749 | B2 * | 1/2011 | Costaglia | A47C 1/03238 297/300.5 |
| 7,866,750 | B2 * | 1/2011 | Bock | A47C 1/024 297/303.1 |
| 8,733,839 | B2 | 5/2014 | Bock | |
| 2009/0267394 | A1 * | 10/2009 | Bock | A47C 1/03255 297/300.2 |
| 2013/0057037 | A1 * | 3/2013 | Horiki | A47C 1/03255 297/301.1 |
| 2016/0309902 | A1 * | 10/2016 | Donati | A47C 1/03255 |

FOREIGN PATENT DOCUMENTS

| | | | |
|---|---|---|---|
| JP | H06261818 | A | 9/1994 |
| JP | 2011193927 | A | 10/2011 |
| WO | 2009103389 | A1 | 8/2009 |

* cited by examiner

MECHANISM FOR AN OFFICE CHAIR

BACKGROUND OF THE INVENTION

Field of the Invention

The invention relates to a mechanism for an office chair, in which the pivoting resistance of the backrest support can be altered. As a rule, it is possible in this respect to select a setting between "hard" and "soft", depending on whether the user of the office chair is a heavy or light person.

EP 2244605 A1 discloses a mechanism for an office chair, having a spring mechanism that has at least one spring element, said spring mechanism being operatively connected to a backrest support of the office chair and determining the pivoting resistance of the backrest support during pivoting from a starting position into a pivoted position, having a movable functional element that is operatively connected to the spring mechanism, and having an actuating element that is operatively connected to the functional element, the position of said actuating element being altered during pivoting of the backrest support.

BRIEF SUMMARY OF THE INVENTION

It is an object of the present invention to provide a mechanism for an office chair, in which a small adjustment travel is sufficient to realize a large adjustment range of the pivoting resistance of the backrest.

This object is achieved by a mechanism as claimed. Advantageous embodiments of the invention are specified in the dependent claims.

Accordingly, provision is made to configure the mechanism such that the actuating element has a supporting and/or guide track for the functional element, the position of which on the supporting and/or guide track is altered during a change in position of the actuating element during pivoting of the backrest support. Provision is furthermore made of a movable control arm for the coupling connection of the functional element to a further structural element of the mechanism, wherein the control arm determines the type of change in position of the functional element on the supporting and/or guide track during pivoting of the backrest support.

In other words, it is a core idea of the invention that the actuating element itself provides the supporting and/or guide track for the functional element, said functional element bringing about a change in the spring tension during pivoting. Since the actuating element always moves during pivoting of the backrest support, the supporting and/or guide track thus also executes at the same time a corresponding movement and therefore influences the change in position of the functional element, without further structural measures being necessary for this purpose. At the same time, the position and the movement of the functional element on the supporting and/or guide track are forced during pivoting by a control arm, said control arm being arranged between the functional element and a further structural element of the mechanism.

Such an arrangement makes it possible, with the aid of an easy-to-realize variable-location connection of the control arm to the further structural element of the mechanism, to realize a large adjustment range of the pivoting resistance of the backrest with a small adjustment travel. Therefore, the mechanism according to the invention requires particularly little space for setting the spring force.

A structural embodiment of the invention that is particularly simple in design terms is possible when the actuating element is firmly connected to the backrest support. It then follows the pivoting movement of the backrest support 1:1.

An embodiment of the invention in which the functional element is a rolling or sliding body, preferably in the form of a cylindrical pin, that is mounted in a variable position and is acted upon directly by the actuating element, has proved to be very particularly advantageous. In such an embodiment, during the pivoting of the backrest support, the dynamic automatic positioning, characterizing the invention, of the functional element can be realized in a particularly simple manner under the influence of the actuating element and simultaneous guidance of the control arm.

The functional element preferably comprises a bearing, wherein the latter is a roller bearing, in particular in the form of a ball bearing or needle bearing. However, it is of course also possible for other bearing devices, for example plain bearings, to be used.

In one embodiment of the invention, the control arm is supported only on the further structural element of the mechanism, without being fixedly connected to the further structural element. In the simplest case, the control arm is located as an inherently rigid component between the functional element and the further structural element of the mechanism, automatically maintaining its position in the process. In this respect, in one embodiment of the invention, the control arm is articulated on the functional element with its one end and clamped against a receptacle in the further structural element with its opposite end. In another case, the position of the control arm supported on the further structural element is maintained in that an additional connecting element that cooperates with the control arm and is preferably attached directly to the control arm is provided, said connecting element forming a releasable connection, locking the support, with the further structural element.

If the control arm is supported only on the further structural element, then it is possible in a particularly simple manner to embody the connection of the control arm to the further structural element in a variable location. A variable-location connection of the control arm to the further structural element is also possible, however, when the control arm is connected to the further structural element in some other way.

The fact that the control arm is connected to the further structural element in a variable location means, in the case of a non-variable-position, i.e. fixed further structural element, that the position of the connection location is variable in that the control arm can be connected to the structural element at different points. In other words, the control arm can be supported at various locations on the further structural element and/or be connected to the structural element at these locations.

According to the invention, a change in the connection location brings about in all cases an altered change in position of the functional element on the supporting and/or guide track during pivoting of the backrest support, and thus an alteration in the pivoting resistance of the backrest from "soft" to "hard" or vice versa.

In one embodiment, the further structural element has a number of mutually adjoining receptacles into which that end of the control arm that is assigned to the further structural element can be successively moved. As a result, an adjustment device for the non-continuous, discrete changing of the pivoting resistance is created. In one embodiment of the invention, a pulling means, preferably in the form of a Bowden cable, which is connected to that end of the control arm that is assigned to the further structural element, serves as adjusting element.

In one embodiment of the invention, the receptacles provided on the further structural element are arranged such that the control arm can be pivoted on a circular path about its articulation point on the functional element, without the connection between the control arm and the further structural element being released. Therefore, during the change in position of the control element with the aid of the adjustment device, the coupling between the functional element and the further structural element is always maintained. Furthermore, the spring force which is applied by the spring mechanism to the movable functional element that is operatively connected to the spring mechanism preferably acts in a perpendicular manner on the supporting and/or guide track provided by the actuating element. As a result, the location of the connection of the control arm to the further structural element of the mechanism can be altered without a substantial change in the position of the functional element on the supporting and/or guide track occurring. Therefore, during the setting of the spring force in the non-pivoted state of the backrest, it is not at all necessary, or necessary only to a very small extent, to work against the force of the at least one spring element of the spring mechanism. Therefore, particularly smooth spring force setting is possible.

In an alternative embodiment of the invention, an adjustment device for the non-continuous, discrete changing of the pivoting resistance is created in that the control arm, supported on the further structural element of the mechanism, is releasably connected to the further structural element via an additional connecting element. In addition to a preferably straight supporting surface, on which the control arm is supported, the further structural element has a number of locking elements in which an additional connecting element can successively engage in order to form a lock, wherein this connecting element is connected to that end of the control arm that is supported on the further structural element. Such an attachment of the control arm to the further structural element is preferably configured such that the control arm, together with its point of articulation on the functional element, is moved in a linear manner during a change in the pivoting resistance that occurs with the aid of the adjustment device. Preferably, the functional element is supported on the further structural element throughout the change in position of the control arm.

In this embodiment of the invention, a change in the connection location of the control arm to the further structural element results in a simultaneous change in the position of the functional element on the supporting and/or guide track. As a result, the distance between the functional element and the main pivot axis of the mechanism changes. This preferably takes place such that this distance increases in the case of a change from a "soft" to a "hard" setting of the pivoting resistance. As a result, the active lever arm, which is determined by the distance between the axis of the functional element and the main pivot axis of the mechanism, said lever arm being essential for the subsequent pivoting movement of the backrest support, lengthens during the setting of the pivoting resistance from "soft" to "hard". As a result, this brings about a greater initial resistance, which needs to be overcome at the start of pivoting when the backrest is pivoted by a user of the chair. In other words, on account of the structural configuration of this embodiment of the invention, the magnitude of the initial resistance of the backrest pivoting movement is adapted to the magnitude of the pivoting resistance. A "hard" setting of the pivoting resistance is assigned a matching higher initial resistance. As a result, in particular heavy persons find structural support on leaning against the backrest. Too light a start of the pivoting movement and thus "collapsing" are prevented. Again, the position of the functional element on the supporting and/or guide track preferably changes in such a way that, during the setting of the spring force in the non-pivoted state of the backrest, it is not at all necessary, or necessary only to a very small extent, to work against the force of the at least one spring element of the spring mechanism. Therefore, in this case, too, particularly smooth spring force setting is possible.

A structural embodiment of the invention that is particularly simple in design terms is possible when the further structural element of the mechanism is part of the base support.

As a result of the change in position of the actuating element during pivoting of the backrest and the change in position, caused thereby, of the functional element, the tension in the at least one spring element is altered according to the invention. In the spring mechanism, any desired types of spring elements for the purposes of the present invention can be used. On account of their simplicity and robustness, helical springs, in particular in the form of helical compression springs, have proved to be particularly advantageous. If a helical compression spring is used, the functional element is preferably a component that acts indirectly or directly on one end of the spring, preferably on a spring seat.

In the simplest case, the supporting and/or guide track can have the form of a circular arc segment. Variations in the concavity of the bearing face, for example initially flat, subsequently becoming steeper etc., are possible and result in different dynamic spring behaviour.

The spring mechanism operatively connected to the backrest support of the office chair can be connected either directly or indirectly to the backrest support. In the case of an indirect connection, the spring mechanism is preferably connected to the backrest support via the seat support as coupling element. The specific structural configuration is dependent on the structure of the office chair and the type of mechanism (synchronous mechanism, asynchronous mechanism).

BRIEF DESCRIPTION OF THE SEVERAL VIEWS OF THE DRAWING

Two exemplary embodiments of the invention are explained in more detail in the following text with reference to the drawings, in which.

DESCRIPTION OF THE INVENTION

Figure 1:
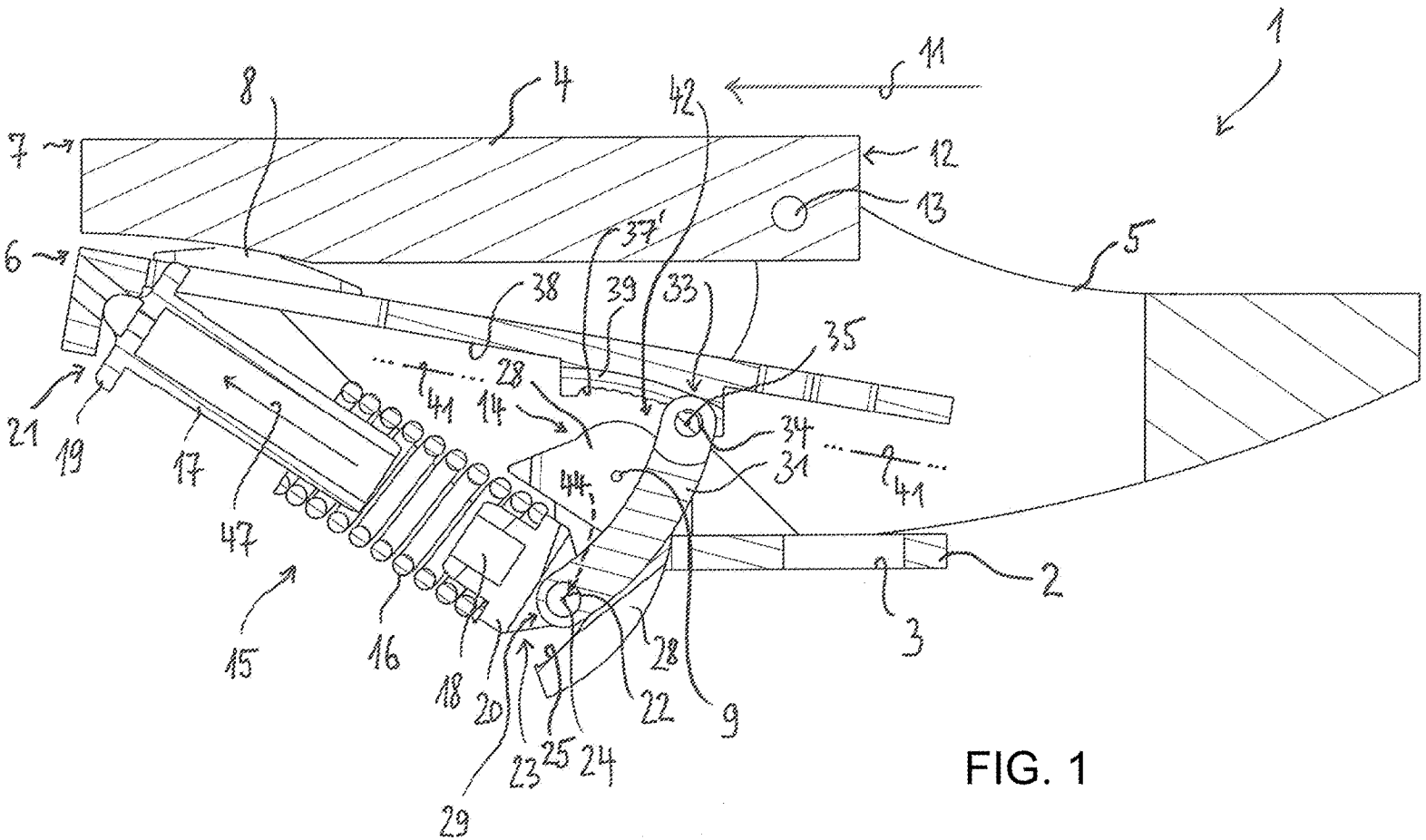
FIG. 1 shows a sectional illustration of a first mechanism with a "soft" setting of the pivoting resistance in a starting position.

All of the figures show the invention merely in a schematic manner and with its essential constituent parts. Identical reference signs in this case correspond to elements with an identical or comparable function.

The figures show parts of a pivoting mechanism 1 for an office chair, wherein only the structural elements that are absolutely necessary for understanding the present invention are illustrated.

The pivoting mechanism 1 comprises a base support 2 having a conical receptacle 3 for the upper end of a chair column, a seat support 4 and a backrest support 5. In this case, the side pieces of the backrest support 5, which is fork-shaped in plan view, are arranged on either side of the base support 2.

The front end 6 of the base support 2 is connected to the front end 7 of the substantially horizontally arranged seat support 4 via a rotary/sliding joint 8 (not depicted in detail). The rear end 12 of the seat support 4 is furthermore connected pivotably to the backrest support 5, to be more precise to an upper side-piece part of the backrest support 5, at bearing points 13. Just as the seat support 4 can be provided with a seat, the backrest support 5 can also be provided with a backrest, wherein neither the type of seat nor the type of backrest is important for the invention. The backrest support 5 is furthermore articulated on the base support 2 with its front end 14, thereby forming the main pivot axis 9, extending transversely to the chair longitudinal direction 11, of the mechanism 1. The bearing points 13 are located behind the main pivot axis 9, as seen in the chair longitudinal direction 11.

Figure 2:
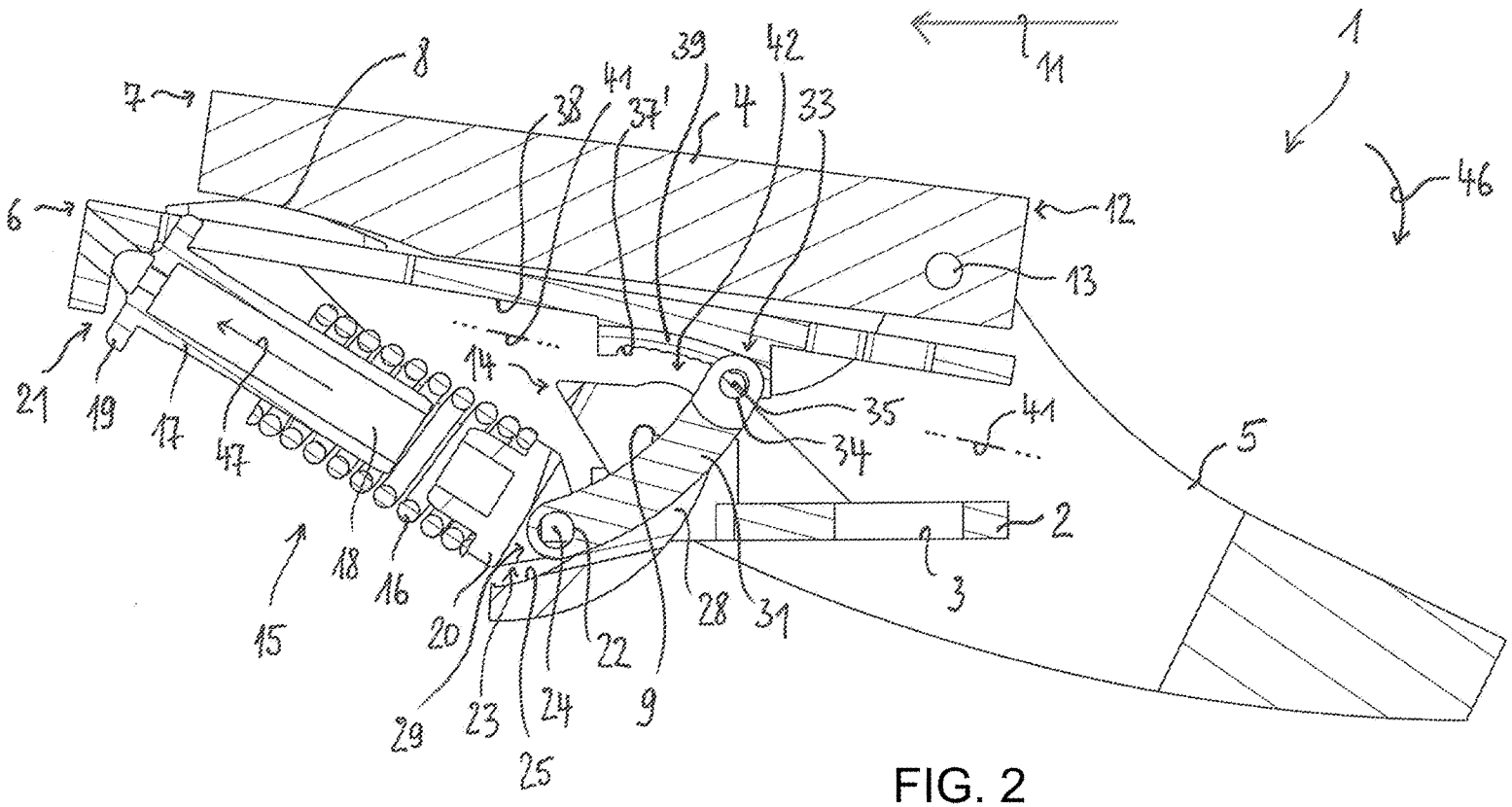
FIG. 2 shows a sectional illustration of the mechanism from FIG. 1 with a "soft" setting of the pivoting resistance in a pivoted position.
Figure 3:
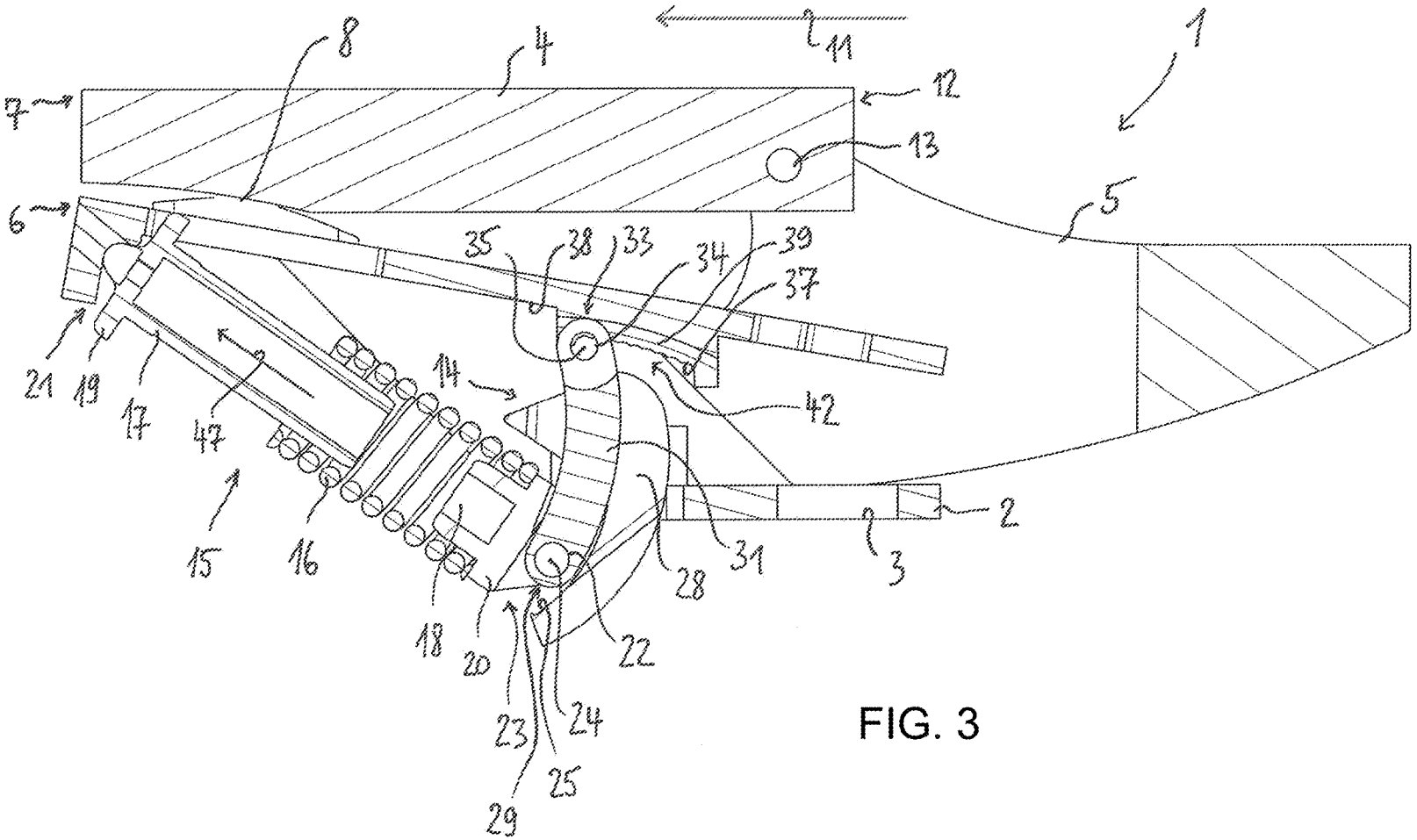
FIG. 3 shows a sectional illustration of the mechanism from FIG. 1 with a "hard" setting of the pivoting resistance in a starting position.
Figure 4:
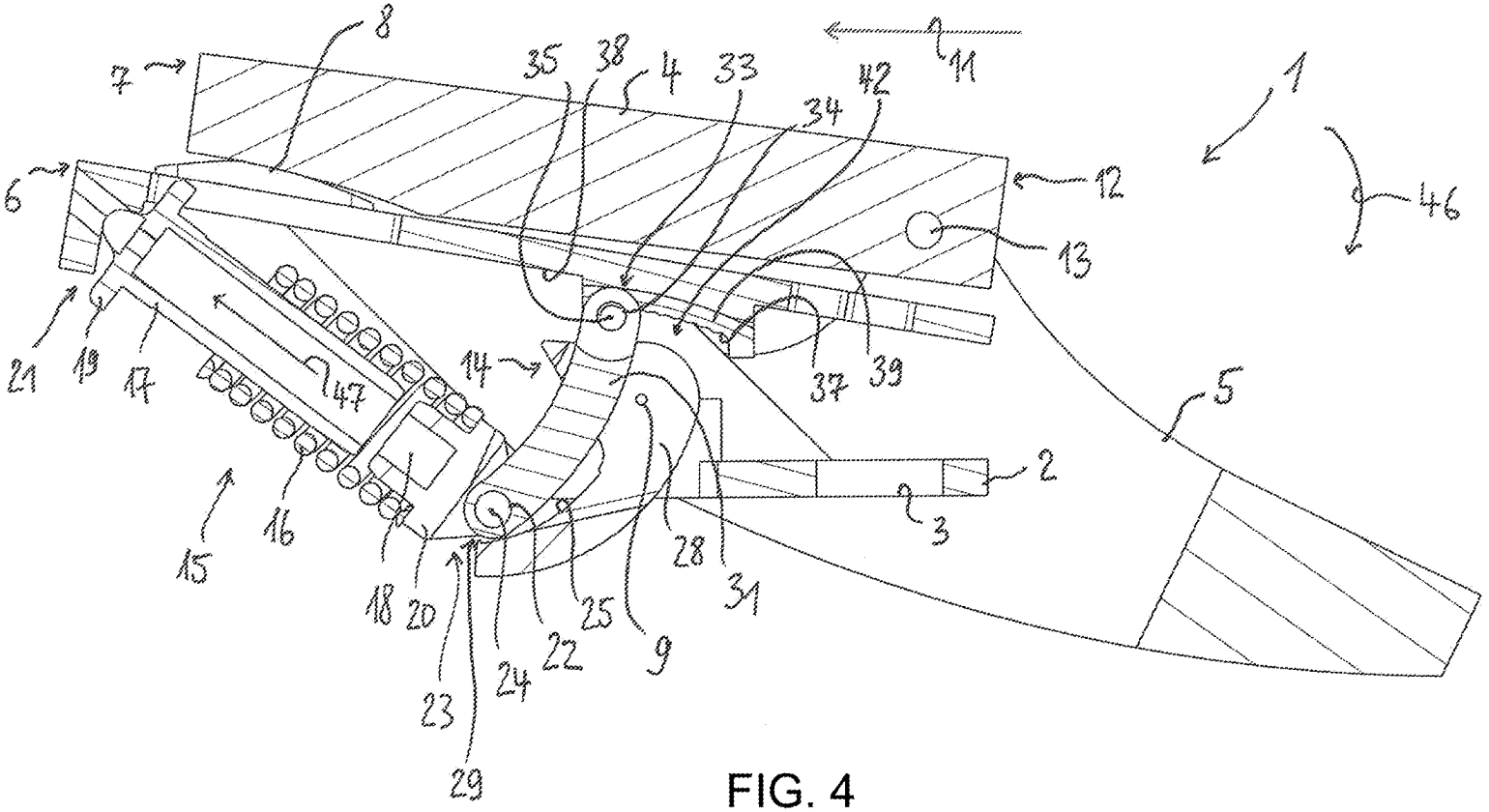
FIG. 4 shows a sectional illustration of the mechanism from FIG. 1 with a "hard" setting of the pivoting resistance in a pivoted position.

When a user leans against the backrest, the backrest support 5 can be transferred from its starting position, illustrated in FIGS. 1 and 3, into a pivoted position, as is illustrated for example in FIGS. 2 and 4. In order to set the restoring force of the backrest support 5, provision is made of a spring mechanism 15, the functioning of which is explained in detail in the following text.

The spring mechanism 15 comprises a helical compression spring 16 arranged centrally in the mechanism 1. In the figures, this compression spring 16 is illustrated only in part for reasons of clarity. A guide device 17, in the form of a hollow cylinder having a guide rod 18 running through it, is inserted in a parallel manner in the compression spring 16, said guide rod 18, as anti-kink protection, preventing the compression spring 16 from bending during compression. The guide device 17 forms a spring seat 19 at the fixed end 21 of the compression spring 16. This spring seat 19 is mounted in an articulated manner at the front end 6 of the base support 2. The guide rod 18 is connected to a spring seat 20 at the movable end 23 of the compression spring 16. This spring seat 20 is connected to a variable-position functional element 22 in the form of a pin-shaped rolling and/or sliding body. The axis 24 of this rolling and/or sliding body 22 extends in this case parallel to the main pivot axis 9 of the mechanism 1. In the starting position of the backrest, the axis 24 of the functional element 22 is located in front of the main pivot axis 9 of the mechanism 1, as seen in the chair longitudinal direction 11. The functional element 22 has two needle bearings 27 for supporting the functional element 22 in a rotational manner on a supporting and/or guide track 25 which is formed by a concave bearing face of a pivot lever 28, said bearing face being open towards the front, as seen in the chair longitudinal direction 11. The pivot lever 28, acting as actuating element, is embodied as part of the backrest support 5 and is connected to the front end 14 of the backrest support 5 in a rotationally fixed manner beneath the main pivot axis 9 of the mechanism 1. The main pivot axis 9 of the mechanism 1 is at the same time the rotation axis of the pivot lever 28.

A lower, fixed end 29 of a coupler 31 that serves as a control arm is pivotably connected to the functional element 22. A lug 32 provided at the end 29 of the coupler 31, said lug 32 surrounding the functional element 22, serves for this purpose.

The exemplary embodiment illustrated in FIGS. 1 to 5 is described in more detail in the following text.

Attached to the upper, movable end 33 of the coupler 31 is a cylindrical clamping pin 34, the longitudinal centre axis 35 of which extends parallel to the main pivot axis 9 of the mechanism 1. Here, too, a lug 36 provided at the end 33 of the coupler 31 serves to guide the clamping pin 34. The clamping pin 34 is supported in a correspondingly shaped receptacle 37 on the underside 38 of the base support 2, such that the coupler 31 is clamped between the functional element 22 and the base support 2.

The receptacle 37 is part of a receiving plate 39 which, together with a Bowden cable 41 that serves as an adjusting element and is illustrated only in part in FIGS. 1 and 2, forms an adjustment device 42 for the coupler 31. For this purpose, the receiving plate 39 has a number of mutually adjoining receptacles 37, into which the free end 33 of the coupler 31 can be successively moved. The Bowden cable 41, which is embodied such that it can move the coupler 31 from one receptacle 37 to the next receptacle 37 and back again, is connected to the free end 33 of the coupler 31 and is supported at suitable points of the base support 2.

Figure 5:
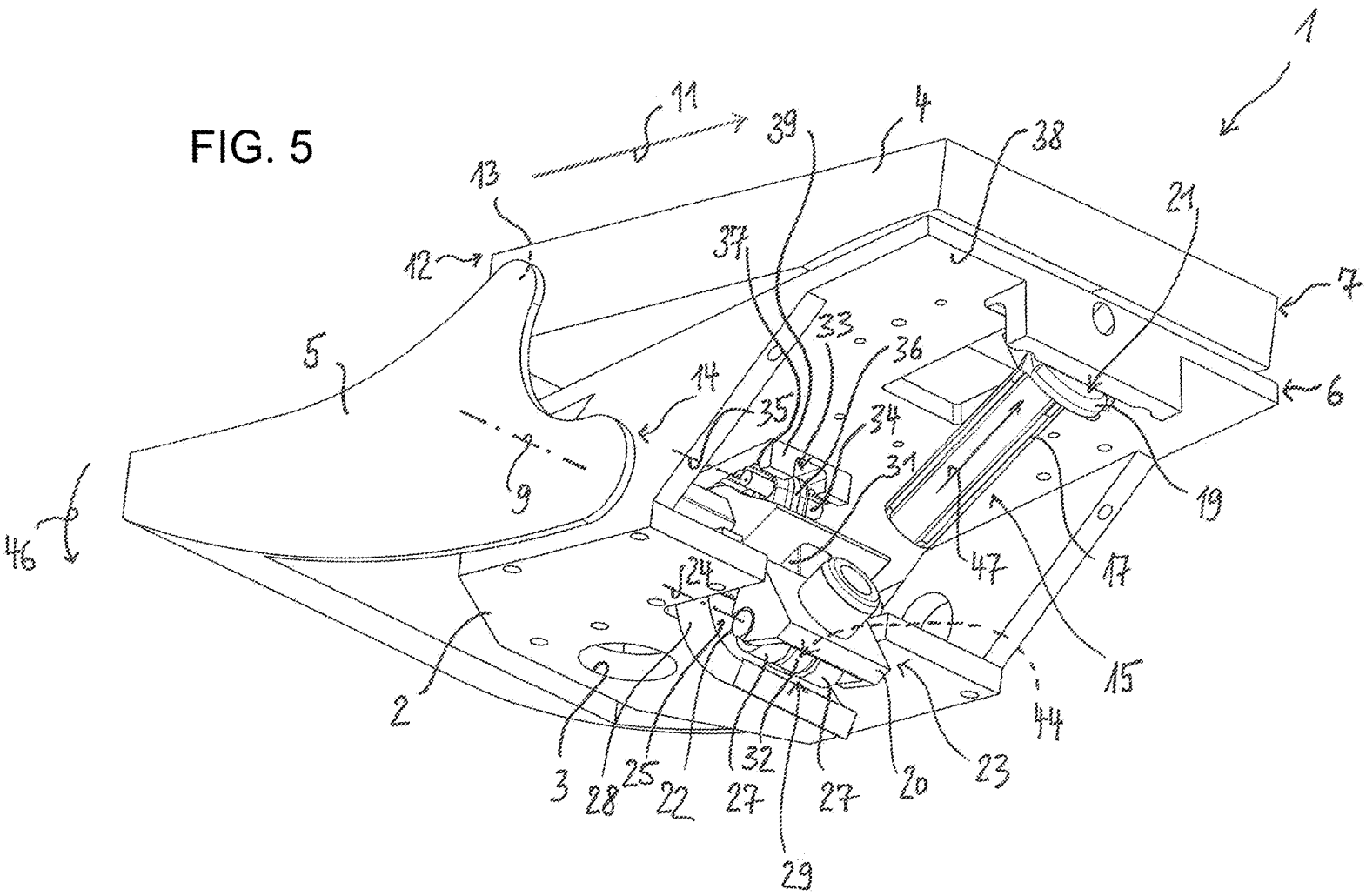
FIG. 5 shows a perspective illustration of the mechanism from FIG. 1 with a "hard" setting of the pivoting resistance.

The receptacles 37 are arranged on the receiving plate 39 such that the coupler 31 can be pivoted on a circular path about its articulation point 44 on the functional element 22, without the connection between the coupler 31 and the underside 38 of the base support 2 being lost. The articulation point 44, which is indicated in FIGS. 1 and 5, is determined by the connection of the lug 32 to the functional element 22. The compression spring 16 is perpendicular or substantially perpendicular to the supporting and/or guide track 25 in the non-pivoted state of the backrest. Therefore, when the clamping pin 34 is moved from one receptacle 37 to the next, essentially only the force which is necessary to overcome the separating strips that separate the individual hollow-like receptacles 37 from one another needs to be applied.

When the backrest support 5 is pivoted downwards and to the rear in the pivoting direction 46, the pivot lever 28 connected to the backrest support 5 likewise pivots in the same manner, with the result that the functional element 22, held at a defined distance from the base support 2 by the coupler 13, is moved on the supporting and/or guide track 25. This results in a defined movement of the functional element 22 depending on the pivoting movement of the backrest support 5.

In the example shown in FIGS. 1 and 2, the free end 33 of the coupler 31 is located in the rearmost receptacle 37, as seen in the chair longitudinal direction 11, of the receiving plate 39, with the result that the "softest" setting of the spring force setting is defined. In the starting position of the backrest, the longitudinal centre axis 35 of the clamping pin 34 is located behind the main pivot axis 9 of the mechanism 1, as seen in the chair longitudinal direction 11. When the backrest support 5 is pivoted, the functional element 22 moves upwards in the direction of the main pivot axis 9 and at the same time forwards in the direction of the front end 6 of the base support 2. As a result, the distance between the spring seats 19, 20 decreases, and the compression spring 16 is compressed.

If the free end 33 of the coupler 31 is moved, with the aid of the Bowden cable 41, from the rearmost receptacle 37, as seen in the chair longitudinal direction 11, into the front receptacle 37', as shown in FIGS. 3 and 4, the "hardest" setting is carried out as a result. The supporting and/or guide track 25 remains unaltered in this case, and in particular the gradient of the track 25 does not change. In the starting position of the backrest, the longitudinal centre axis 35 of the clamping pin 34 is then located in front of the main pivot axis 9 of the mechanism 1, as seen in the chair longitudinal direction 11, and just behind the axis 24 of the functional element 22. As a result of the adjustment device 42 being actuated, the position of the coupler 31 changes relative to the position of the compression spring 16, to be more precise relative to the spring longitudinal direction 47, but not the length of the coupler 31. Therefore, when the backrest support 5 is pivoted, an altered ratio of the acting forces arises, this being expressed in an altered movement of the functional element 22.

When the backrest support 5 is pivoted, the functional element 22 moves downwards away from the main pivot axis 9 and at the same time forwards in the direction of the front end 6 of the base support 2. As a result, the distance between the spring seats 19, 20 decreases much more greatly and the compression spring 16 is compressed more strongly than in the case of the above-described "soft" setting. At the same time, the active lever arm (not shown) which is essential for the pivoting movement of the backrest support 5 is enlarged, said lever arm being determined by the distance between the axis 24 of the functional element 22 and the main pivot axis 9 of the mechanism 1. At the same time, on account of the changed position of the compression spring 16, coupler 31 and pivot lever 28 with respect to one another, the sum of the forces effectively acting on the pivot lever 28 increases. Overall, this results in considerably increased pivoting resistance.

Overall, in spite of the only small adjustment travel between the rearmost receptacle 37 and the front receptacle 37' of the adjustment device 42, a large adjustment range of the spring force adjustment arises. In other words, as a result of a comparatively small change in the position of the free end 33 of the coupler 31, a spring force adjustment from a very soft to a very hard setting and vice versa can take place.

Figure 6:
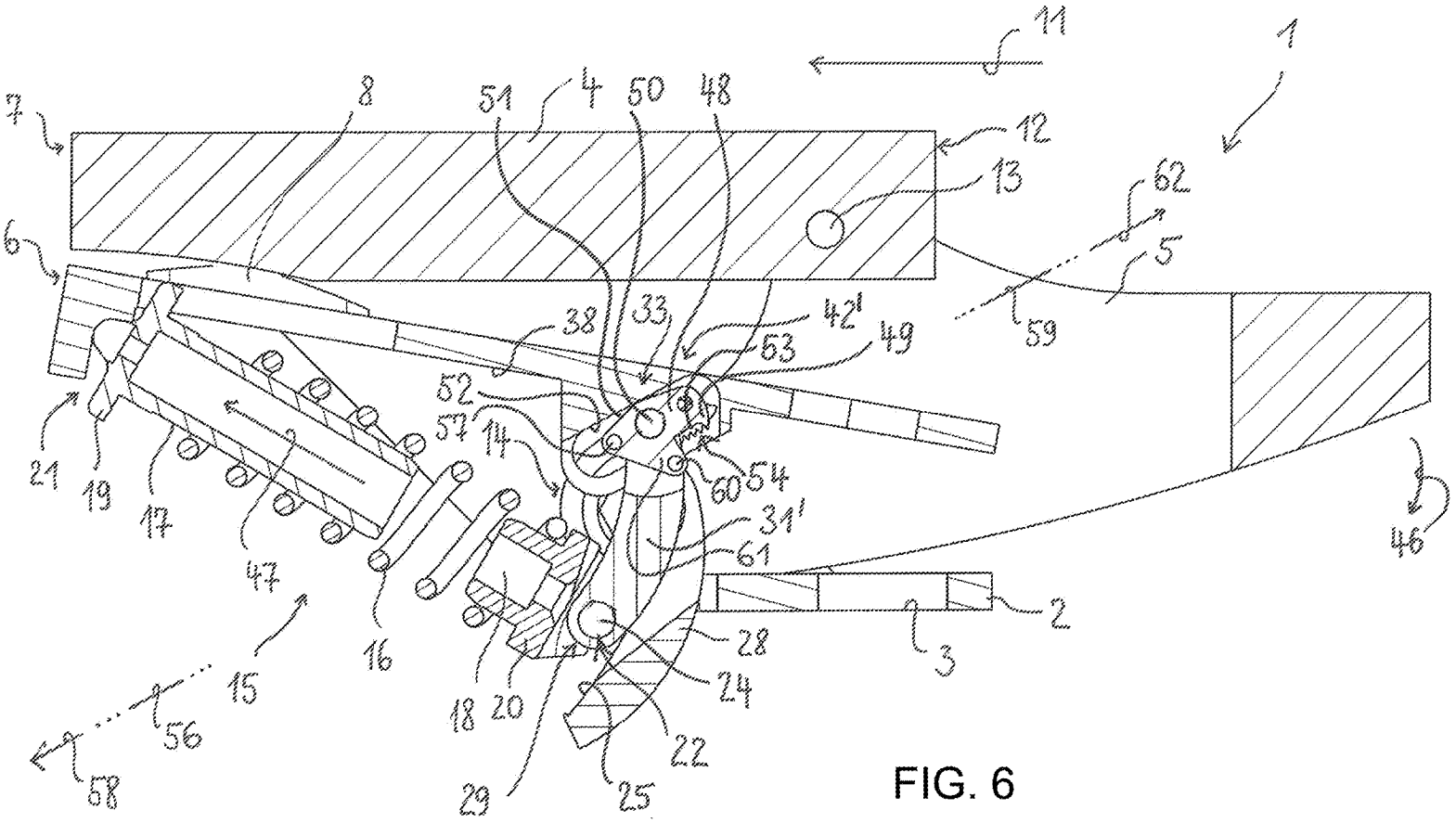
FIG. 6 shows a sectional illustration of a second mechanism with a "soft" setting of the pivoting resistance in a starting position.
Figure 7:
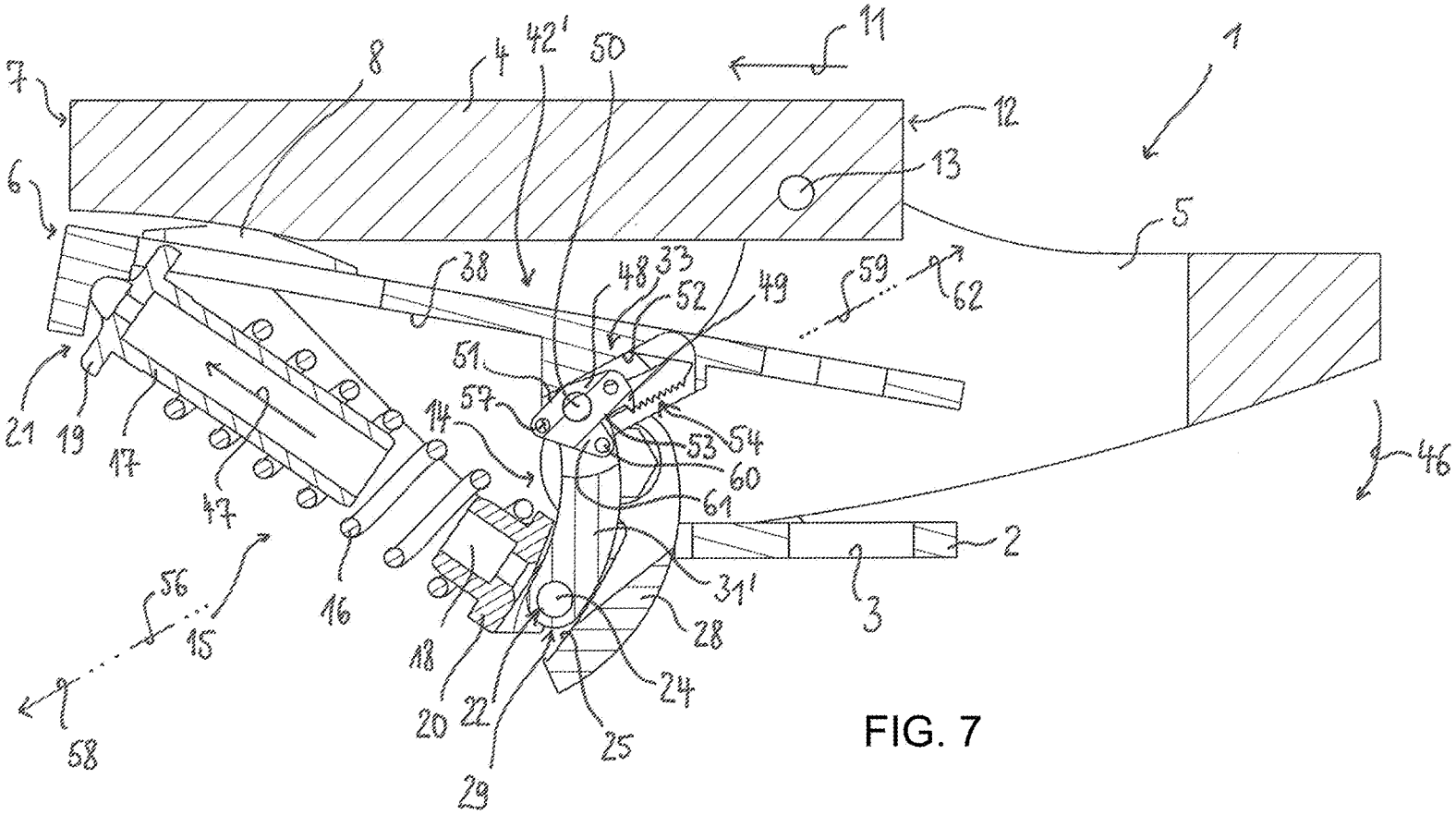
FIG. 7 shows a sectional illustration of a second mechanism with a "hard" setting of the pivoting resistance in a starting position.

In the following text, the exemplary embodiment illustrated in FIGS. 6 and 7 is described in more detail. This exemplary embodiment differs from the above-described exemplary embodiment primarily by the manner in which the upper end 33 of the coupler 31' is connected to the base support 2. Instead of a self-locking configuration, locking that is establishable with the aid of an additional connecting element 48 is provided. This results, in addition to an altered adjustment device 42', in particular in an altered change in position of the functional element 22 on the supporting and/or guide track 25 during pivoting of the backrest support 5. All further essential features, in particular the resulting functional advantages of the mechanism 1, remain the same, however, or result in a corresponding manner.

The additional connecting element 48 is articulated on the upper, movable end 33 of the coupler 31'. The connecting element 48 comprises a pawl 49. The connecting element 48, which is pivotable about a locking pivot axis 50 extending parallel to the main pivot axis 9 of the mechanism 1, is supported on a planar supporting face 52 by way of its one side 51 facing the base support 2. This supporting face 52 is provided on the underside 38 of the base support 2, rigidly connected to the base support 2, and defines a rectilinear guide track for the upper end 33 of the coupler 31' when the pivoting resistance is adjusted.

The position of the coupler 31' between the functional element 22 and base support 2 is maintained in that the pawl 49 provided on the opposite side 53 of the connecting element 48, that is to say the side facing away from the supporting face 52, engages in locking elements in the form of locking teeth 54 and thus locks the connecting element 48 and thus the coupler 31' on the base support 2, forming a ratchet. The locking teeth 54 are arranged in the form of a rectilinear tooth strip extending parallel to the supporting face 52 and, together with the supporting face 52 to which they are firmly connected, form the further structural element within the meaning of the invention. Every time the backrest support 5 is pivoted in the pivoting direction 46, the coupler 31' is urged in the direction of the supporting face 52. As a result, the coupler 31', to be more precise the top side 51 of the connecting element 48 of the coupler 31', is supported on the supporting face 52. Displacement of the connecting element 48 on the flat supporting face 52 in the direction of a "softer" setting, upwardly to the right in the figures, is prevented, however, in that the pawl 49 locks in the locking teeth 54.

In the example shown in FIG. 6, the connecting element 48 is supported on the rearmost abutment point, as seen in the chair longitudinal direction 11, of the supporting face 52, and the pawl 49 is located next to the rearmost locking tooth 54, as seen in the chair longitudinal direction 11, in the tooth strip, with the result that the "softest" setting of the spring force setting is defined. In the starting position of the backrest, the locking pivot axis 50 of the connecting element 48 is located behind the main pivot axis 9 of the mechanism 1, as seen in the chair longitudinal direction 11.

In order to alter the pivoting resistance from "soft" to "hard", provision is made of a first Bowden cable 56 (indicated merely symbolically and away from its actual position in the figures for the sake of clarity) as adjusting element, said first Bowden cable 56 acting on a first engagement point 57 of the connecting element 48 and being supported at suitable points on the base support 2. This first engagement point 57 is provided on the connecting element 48 such that the connecting line between the first engagement point 57 and the locking pivot axis 50 of the connecting element 48 extends parallel to the supporting face 52. In the event of a pull in the first pulling direction 58 defined thereby, the pawl 49 is unlocked and the locking brought about by the pawl 49 is overcome. The ratchet formed by the pawl 49 and locking teeth 54 acts in this case as a type of limit-force ratchet, in which the locking forces can be overcome by a pull in the first pulling direction 58. An increase in the pivoting resistance, i.e. an alteration in the position of the coupler 31' into a respectively "harder" position, is possible in each case by renewed actuation of the first Bowden cable 56.

On the other hand, if the pivoting resistance is intended to be reduced, that is to say the coupler 31' moved into a "softer" position, this is not possible with the aid of the first Bowden cable 56. This is because, on account of the connecting element 49 being supported on the supporting face 52 with simultaneous engagement of the pawl 49 in the locking teeth 54, the ratchet formed by the pawl 49 and locking teeth 54 acts as a kind of directional ratchet, which does not allow a movement of the connecting element 48 counter to the first pulling direction 58. Therefore, in order to alter the pivoting resistance from "hard" to "soft", provision is made of a second Bowden cable 59 (indicated merely symbolically and away from its actual position in the figures for the sake of clarity) as adjusting element, said second Bowden cable 59 acting at a second engagement point 60, different from the first engagement point 57, of the connecting element 48 and being supported at suitable points on the base support 2. This second engagement point 60 is provided on the connecting element 48 such that it is not located on the connecting line between the first engagement point 57 and the locking pivot axis 50 of the connecting element 48. Instead, the second engagement point 60 is arranged on a lever arm 61, acting on the pawl 49, of the connecting element 48 such that in the event of a pull in the second pulling direction 62, which is different from the first pulling direction 58, a torque acts on the pawl 49 such that the latter is unlocked. In other words, the pawl 49, which is embodied as part of the connecting element 48, is raised and pivoted out of the locking teeth 54 in that the entire connecting element 48 is pivoted about its locking pivot axis 50 on the coupler 31'. A reduction in the pivoting resistance, i.e. an alteration in the position of the coupler 31' into an in each case "softer" position, is then possible in each case by renewed actuation of the second Bowden cable 59.

If the upper end 33 of the coupler 31' was moved, with the aid of the first Bowden cable 56, from the rearmost engagement point, as seen in the chair longitudinal direction 11, of the supporting face 52 to the front engagement point, as shown in FIG. 7, the "hardest" setting is carried out as a result. In the starting position of the backrest, the locking pivot axis 50 of the connecting element 48 is then located again in front of the main pivot axis 9, as seen in the chair longitudinal direction 11, of the mechanism 1 and just behind the axis 24 of the functional element 22.

During the setting of the pivoting resistance, an alteration in the position of the coupler 31' always takes place such that the upper end 33 of the coupler 31' is moved in a linear manner corresponding to the guide track defined by the supporting face 52. The position of the functional element 22, connected to the fixed end 29 of the coupler 31', on the supporting and/or guide track 25 is likewise altered in the process. In other words, not only does the upper end 33 move on the supporting face 52 but the fixed end 29 of the coupler 31' also moves on the supporting and/or guide track 25 when the pivoting resistance is increased towards the front in the chair longitudinal direction 11 and when the pivoting resistance is reduced towards the rear in the chair longitudinal direction 11. Thus, the coupler 31' is always moved as a whole when the pivoting resistance is changed.

During the setting of the pivoting resistance, the functional element 22 moves in a defined, constant relationship with respect to the movement of the upper end 33 of the coupler 31'. While the upper end 33 of the coupler 31' moves in each case in the first pulling direction 58 or counter to the first pulling direction 58, the fixed end 29 of the coupler 31' moves with the functional element 22 on a circular path around the fixed point 21 of the helical compression spring 16. On account of this movement path, when the pivoting resistance is set, the helical compression spring 16 is not compressed or is only compressed to an insignificant extent. The pivoting resistance is therefore particularly easy to set.

All of the features represented in the description, the following claims and the drawings can be essential to the invention both individually and in any desired combination with one another.

LIST OF REFERENCE SIGNS

1 Pivoting mechanism
2 Base support
3 Conical receptacle
4 Seat support
5 Backrest support
6 Front end of the base support
7 Front end of the seat support
8 Rotary/sliding joint
9 Main pivot axis
10 (not used)
11 Chair longitudinal direction
12 Rear end of the seat support
13 Bearing point
14 Front end of the backrest support
15 Spring mechanism
16 Helical compression spring
17 Guide device
18 Guide rod
19 Spring seat
20 Spring seat
21 Fixed end of the spring
22 Functional element, rolling and/or sliding body
23 Movable end of the spring
24 Axis of the functional element
25 Supporting and/or guide track
26 (not used)
27 Needle bearing
28 Pivot lever
29 Fixed end of the coupler
30 (not used)
31 Coupler
32 Lug
33 Movable end/free end of the coupler
34 Clamping pin
35 Longitudinal centre axis
36 Lug
37 Receptacle
38 Underside of the base support
39 Receiving plate
40 (not used)
41 Bowden cable
42 Adjustment device
43 (not used)
44 Articulation point
45 (not used)
46 Pivoting direction
47 Spring longitudinal direction
48 Connecting element
49 Pawl
50 Locking pivot axis
51 Top side of the connecting element
52 Supporting face
53 Underside of the connecting element
54 Locking tooth
55 (not used)
56 First Bowden cable
57 First engagement point
58 First pulling direction
59 Second Bowden cable
60 Second engagement point
61 Lever arm
62 Second pulling direction

The invention claimed is:

1. A mechanism for an office chair, the mechanism comprising:

a spring mechanism having at least one spring element, said spring mechanism being operatively connected to a backrest support of the office chair and configured to determine a pivoting resistance of the backrest support during a pivoting from a starting position into a pivoted position;

a movable functional element operatively connected to said spring mechanism;

a movable actuating element operatively connected to said functional element and being disposed so that a position of said actuating element is altered during the pivoting of the backrest support, said actuating element having a track for said functional element, and wherein a position of said functional element on said track is altered during a change in the position of said actuating element during the pivoting of the backrest support; and a movable control arm for a coupling connection of said functional element to a further structural element of the mechanism, said control arm being configured to determine a type of change in the position of said functional element on said track during the pivoting of the backrest support, said control arm being connected to said further structural element of the mechanism in a variable location.

2. The mechanism according to claim 1, wherein said actuating element is firmly connected to the backrest support.

3. The mechanism according to claim 1, wherein said functional element is a rolling or sliding body mounted in a variable position and said functional element is acted upon directly by said actuating element.

4. The mechanism according to claim 3, wherein said functional element is a cylindrical pin.

5. The mechanism according to claim 3, wherein said functional element has at least one bearing.

6. The mechanism according to claim 5, wherein said at least one bearing is a roller bearing.

7. The mechanism according to claim 1, wherein said control arm is supported on said further structural element of the mechanism.

8. The mechanism according to claim 1, wherein the location of the connection of said control arm to said further structural element of the mechanism is variable while the position of said functional element on said track remains substantially unaltered.

9. The mechanism according to claim 1, wherein the location of the connection of said control arm to said further structural element of the mechanism is variable, and wherein a variation thereof is associated with a simultaneous change in the position of said functional element on said track.

10. The mechanism according to claim 1, wherein a change in the connecting location brings about an altered change in a position of said functional element on said track during the pivoting of the backrest support.

11. The mechanism according to claim 1, wherein said further structural element of the mechanism is a part of a base support of the mechanism.

* * * * *